US009708103B2

(12) United States Patent
Thies

(10) Patent No.: US 9,708,103 B2
(45) Date of Patent: Jul. 18, 2017

(54) RECEPTACLE, AND METHOD AND DEVICE FOR PRODUCING RECEPTACLES

(71) Applicant: Windmöller & Hölscher KG, Lengerich (DE)

(72) Inventor: Jörg-Christian Thies, Dissen (DE)

(73) Assignee: Windmöller & Hölscher KG, Lengerich (DE)

( * ) Notice: Subject to any disclaimer, the term of this patent is extended or adjusted under 35 U.S.C. 154(b) by 0 days.

(21) Appl. No.: 14/381,566

(22) PCT Filed: Jan. 30, 2013

(86) PCT No.: PCT/EP2013/051712
§ 371 (c)(1),
(2) Date: Aug. 27, 2014

(87) PCT Pub. No.: WO2013/127590
PCT Pub. Date: Sep. 6, 2013

(65) Prior Publication Data

US 2015/0104119 A1 Apr. 16, 2015

(30) Foreign Application Priority Data

Feb. 27, 2012 (DE) ..... 20 2012 100 652 U
May 29, 2012 (DE) ..... 10 2012 104 619

(51) Int. Cl.
*B65D 33/10* (2006.01)
*B65D 30/00* (2006.01)
(Continued)

(52) U.S. Cl.
CPC ..... *B65D 31/00* (2013.01); *B31B 1/14* (2013.01); *B31B 1/25* (2013.01); *B31B 1/58* (2013.01);
(Continued)

(58) Field of Classification Search
CPC ..... B65D 31/00; B65D 31/08; B65D 31/10; B65D 33/00; B65D 33/08
(Continued)

(56) References Cited

U.S. PATENT DOCUMENTS 143,321 A * 9/1873 Benner ..... B65D 31/00 383/107
146,773 A * 1/1874 Murphy ..... B65D 33/007 383/35
(Continued)

FOREIGN PATENT DOCUMENTS

DE 647 889 A 7/1937
DE 720665 C 5/1942
(Continued)

OTHER PUBLICATIONS

International Search Report, mailing date Apr. 16, 2013, for corresponding International Application No. PCT/EP2013/051712, with English translation.
(Continued)

*Primary Examiner* — Jes F Pascua
(74) *Attorney, Agent, or Firm* — Intellectual Property Law Group LLP

(57) ABSTRACT

The invention relates to a receptacle (10), in particular a flexible bag (10) made of paper, with a front part (20), a back part (30) and a bottom (50), which is closed by a bottom unit, and with an opening (1) lying opposite the bottom (50), wherein the bottom unit has a bottom portion (120) of the front part (20) and a bottom portion (130) of the back part (30), the bottom portion (130) of the back part (30) is shorter than the bottom portion (120) of the front part (20), such that the bottom portion (120) of the front part (20) is secured directly on the back part (30) by turning the bottom unit (100) back along a fold line (101), and the opening (1) is formed by a peripheral edge (2) which extends at a height of
(Continued)

the front part (20) and of the back part (30) and which is at least partially frayed, thereby reducing the danger of injury at the edge (2).

7 Claims, 8 Drawing Sheets

(51) Int. Cl.

| | |
|---|---|
| ***B65D 30/18*** | (2006.01) |
| ***B65D 30/20*** | (2006.01) |
| ***B65D 33/08*** | (2006.01) |
| ***B65D 33/00*** | (2006.01) |
| ***B31B 1/14*** | (2006.01) |
| ***B31B 1/25*** | (2006.01) |
| ***B31B 1/58*** | (2006.01) |
| ***B31B 1/86*** | (2006.01) |

(52) U.S. Cl.
CPC ..... *B31B 1/86* (2013.01); *B65D 31/08* (2013.01); *B65D 31/10* (2013.01); *B65D 33/00* (2013.01); *B65D 33/08* (2013.01); *B31B 2221/20* (2013.01); *B31B 2237/10* (2013.01); *B31B 2237/20* (2013.01); *B31B 2237/403* (2013.01)

(58) Field of Classification Search
USPC ..... 383/35, 123, 124, 10, 17, 120
See application file for complete search history.

(56) References Cited

U.S. PATENT DOCUMENTS

| | | | | | |
|---|---|---|---|---|---|
| 439,849 | A | * | 11/1890 | Taylor et al. | B65D 31/00 383/124 |
| 551,611 | A | * | 12/1895 | Appel | B65D 31/00 383/123 |
| 1,984,927 | A | | 12/1934 | Henkel | |
| 2,114,855 | A | * | 4/1938 | Munson | B65D 33/18 383/123 |
| 2,132,669 | A | * | 10/1938 | Wolf | B65D 33/243 383/10 |
| 2,149,872 | A | * | 3/1939 | Schmidt | B65D 31/08 383/124 |
| 2,239,857 | A | * | 4/1941 | Poppe | B65D 33/243 229/68.2 |
| 2,466,823 | A | * | 4/1949 | Poppe | B31B 37/00 225/100 |
| 2,781,162 | A | * | 2/1957 | Soffa | B65D 33/243 383/10 |
| 2,855,832 | A | * | 10/1958 | Mengis | B31B 19/86 493/223 |
| 3,104,797 | A | * | 9/1963 | Langenfeld | B31B 19/14 383/123 |
| 3,227,359 | A | | 1/1966 | Hanlon | |
| 5,328,439 | A | * | 7/1994 | Goldberg | B31B 1/22 493/467 |
| 6,191,382 | B1 | * | 2/2001 | Damikolas | B23K 26/04 156/272.8 |
| 2010/0124386 | A1 | * | 5/2010 | Sturgis | B65D 75/008 383/10 |

FOREIGN PATENT DOCUMENTS

| | | | |
|---|---|---|---|
| DE | 840500 | C | 6/1952 |
| DE | 37 43 510 | A1 | 7/1989 |
| DE | 100 11 937 | A1 | 8/2001 |
| DE | 102008017726 | A1 | 10/2009 |
| FR | 1353423 | A | 2/1964 |
| GB | 1352504 | A | 5/1974 |

OTHER PUBLICATIONS

Written Opinion of the ISA, mailing date Apr. 16, 2013, for corresponding International Application No. PCT/EP2013/051712, with English translation.

German Office Action, dated Dec. 10, 2012 for corresponding German Patent Application 10 2012 104 619.0 with English Translation.

* cited by examiner

RECEPTACLE, AND METHOD AND DEVICE FOR PRODUCING RECEPTACLES

CROSS-REFERENCE TO RELATED APPLICATIONS

This application is a U.S. National Phase application, under 35 U.S.C. §371, of International Application no. PCT/EP2013/051712, with an international filing date of Jan. 30, 2013, and claims benefit of German Application no. 20 2012 100 652.9 filed on Feb. 27, 2012 and German Application No. 10 2012 104 619.0 filed on May 29, 2012, which are hereby incorporated by reference for all purposes.

BACKGROUND OF THE INVENTION

1. Field of the Invention

The invention relates to a receptacle, in particular to a flexible bag made of paper, having a front part, a rear part and a bottom which is closed by a bottom unit, and having an opening which is located opposite the bottom.

In addition, the invention relates to a device for producing receptacles, wherein the device comprises the following features:

- a perforation device for creating perforation lines on a material web, wherein the perforation lines can be created substantially transversely with respect to a conveying direction of the material web,
- a tube forming device for forming a tube from the material web,
- a separating device for separating off individual tube portions and/or material portions of tube portions on the perforation lines and
- a bottom folding device for forming a bottom on an end of the tube portion.

In addition, the invention relates to a method for producing the named receptacles.

2. Background Art

DE 10 2008 017 726 makes known producing paper bags of the above-mentioned type, the bag comprising a front part, a rear part and a bottom which is closed. An opening is situated on the opposite side of the bottom such that objects are able to be moved through the opening into the bag. It has been shown in a disadvantageous manner that in some applications the edge of the opening can be realized with sharp edges such that the user of the paper bags can cut himself on the hand, for example, on the named edge.

SUMMARY OF THE INVENTION

It is the object of the present invention to avoid the above-mentioned disadvantages, in particular to create a receptacle as well as a device for producing said receptacles, it preferably not being possible for the user of said receptacles to cut himself on the hand at the edge of the receptacle opening.

The object of the present invention, according to an embodiment, is achieved by a receptacle, in particular a flexible bag made from paper, having a front part, a rear part and a bottom which is closed by a bottom unit, and having an opening which is located opposite the bottom, wherein the bottom unit comprises a bottom portion of the front part and a bottom portion of the rear part, wherein the bottom portion of the rear part is realized in a shortened manner in relation to the bottom portion of the front part such that the bottom portion of the front part is fastened directly on the rear part as a result of turning the bottom unit along a fold line, the opening is formed by a peripheral edge which extends at a height of the front part and of the rear part and which is frayed at least in part, as a result of which the risk of injury on the edge is reduced. The peripheral edge is the same height on the front part and on the rear part. The frayed edge is realized in an obtuse manner for the user of such receptacles without there being a risk of cutting on the opening of the receptacle. In an advantageous manner, the receptacle is realized from paper and can be used in the form of a flexible bag in the most varied of manners. The frayed edge can be realized according to the invention in a microscopically felt-like manner, as a result of which a relatively "soft" edge is created.

According to the invention, the edge can be realized in the manner of a perforation, this means that said edge is created on the receptacle, for example, by means of a tearing operation. The tearing operation can promote the frayed edge according to the invention.

The receptacle according to the invention is advantageously realized with a folding bottom where the bottom portion of the rear part is realized in a shortened manner in relation to the bottom portion of the front part such that the bottom portion of the front part is fastened, in particular glued, directly on the rear part as a result of turning or folding the bottom unit along the fold line. In an advantageous manner, the bottom portion of the rear part and the bottom portion of the front part can comprise a frayed edge. From the viewpoint of the production process, it makes sense to use just one perforation device in order to have the frayed edge of the opening created and to process the bottom unit with its bottom portions using the same perforation device.

The receptacle can be realized as a folding bottom bag where the front part comprises an outside and an inside and the rear part comprises an outside and an inside, wherein the inside of the front part faces the inside of the rear part, wherein the bottom portion of the front part comprises an inside surface and an outside surface and the bottom portion of the rear part comprises an inside surface and an outside surface, wherein the inside surface of the bottom portion of the front part is glued to the outside of the rear part.

In addition, it can be provided according to the invention that at least one side folding extends between the front part and the rear part. The side folding can comprise one or several side folds. In an advantageous manner, the side folding extends from the opening proceeding in the direction of the bottom. A function of the side folding is that the cavity inside the receptacle is able to be reliably enlarged by the front part and the rear part being pressed away from one another. In the non-use state of the receptacle, the front part and the rear part can lie one on top of the other, the side folds lying between said two parts.

In a measure which improves the invention, the edge of the opening can be formed at least in part by a front part edge of the front part and a rear part edge of the rear part, wherein the front part edge and the rear part edge are at one height. The arrangement of the front part edge and of the rear part edge at one height promotes the fact that the user is easily able to grasp the receptacle at the edge of the opening and consequently is able to transport the receptacle with its contents in a satisfactory manner. The front part edge and the rear part edge are aligned with one another at one height, both the front part edge and the rear part edge being frayed according to the invention.

The invention includes that the front part and/or the rear part is realized at least in part from a transparent material.

The transparent material enables the user to be able to look at least in part into the cavity of the receptacle.

It is equally conceivable that a handle opening is realized on the front part and on the rear part, wherein the handle opening is, for example, punched out. The handle opening can also be created on the receptacle by means of alternative mechanisms or methods. For example, the handle opening can be realized on the receptacle by means of a laser. The handle opening serves as holding means for the user in order to be able to hold and transport the receptacle filled with contents in a reliable manner at the handle opening. In an advantageous manner it can be provided that in the region of the handle opening the inside of the front part and the inside of the rear part comprise a reinforcement strip. So that the handle opening is realized so as to have a long service life, the reinforcement strips effectively prevent premature tearing of the receptacle at the handle opening, which can be brought about, for example, as a result of there being too much weight to be carried inside the cavity of the receptacle. The reinforced strips are advantageously arranged on the inside of the receptacle so that they are not visible to the user. The geometry of the handle opening can be realized in a round or oval manner or as a C-hole opening.

In a further development of the invention, the outside surface of the bottom portion of the front part can serve as an information field. Consequently, part of the bottom unit can serve as an information surface, which can comprise letters, symbols and/or numbers.

In addition, the object of the present invention is achieved by a device according to embodiments of the invention as discussed below. Possible developments of the device are realized in other embodiments of the invention as further discussed below.

The device according to the invention serves for producing receptacles, in particular flexible bags made of paper. The receptacle is realized according to the invention with a front part, a rear part, a bottom which is closed by a bottom unit, as well as an opening which is located opposite the bottom and is defined by a peripheral edge, wherein the edge is formed by a front part edge of the front part and a rear part edge of the rear part. In addition, the device according to the invention comprises the following features:

- a perforation device for creating perforation lines on a material web, wherein the perforation lines can be created substantially transversely with respect to a conveying direction of the material web,
- a tube forming device for forming a tube from the material web,
- at least one separating device for separating off individual tube portions and/or material portions of tube portions on the perforation lines, a bottom folding device for forming a bottom on an end of the tube portion.

According to the invention, the perforation device is realized in such a manner that a first perforation line can be introduced to create the bottom and a second perforation line, which is at a spacing from the first perforation line, can be introduced for creating the frayed edge, wherein the front part edge and the rear part edge are at one height.

A substantial core of the invention is that the perforation device is able to create at least two perforation lines on the material web. For example, the perforation lines can be introduced into the material web by means of cutting elements, in particular cutters, the perforation device according to the invention being able to apply two different contours of perforation lines on the material web. It must be mentioned at this point that the perforation device, in an advantageous manner, does not cut through the material web, but provides the material web with weakening cuts in the form of perforations, along which perforation lines the tube to be formed subsequently tears to separate out into tube portions. The perforation lines for the subsequent tearing off of the material portions of tube portions are also introduced into the material web in the perforation device. For example, it can be provided in a possible embodiment of the invention that the perforation device is situated on a rotating axis, in particular a roller, along which the material web is also guided. A further essential core of the invention is that the device according to the invention comprises a separating device for separating off individual tube portions and individual material portions of tube portions which is incorporated in the device according to the invention. This means that one and the same device can carry out at least two different separations of tube portions and material portions from the material web. Consequently, the material web can be processed in such a manner that both a receptacle with a folding bottom can be produced and also a receptacle with a "smooth" edge where the front part edge and the rear part edge are at one height. In addition, the edge of the opening is frayed such that a risk of injury to the user is reduced.

According to the invention, it can be provided that the separating device comprises a first and a second separating station, wherein in the first separating station individual tube portions can be separated off along the first perforation line, and in the second separating station material portions of tube portions can be separated off along the second perforation line. In this connection, the separating device serves, on the one hand, for separating the tube portions into singles. This is realized in an advantageous manner by the first separating station which separates or tears the individual tube portions off along the first perforation line. The second separating station removes material portions of the respective tube portions on the opposite side of the bottom in order to obtain a "smooth" edge at the opening of the receptacle. It must be mentioned in this context that a device for removing the material portions can be incorporated in addition in the separating device according to the invention. It is the object of said device to remove the separated material portions of the second separating station reliably from the transport path of the tube portions or bags such that there are no resultant inaccessibilities in the production of the receptacles. Said device can include suction devices, grabs, needles or a combination of suction devices and grabs and needles.

It can be provided according to the invention that the first separating station is arranged upstream of the bottom folding device and the second separating station is arranged downstream of the bottom folding device. This means that initially individual tube portions are separated off along the first perforation line in a first translation. Once the bottom has been formed in the bottom folding device, the material portions of the respective tube portions are separated off along the second perforation line in the second separating station which is connected downstream. Depending on the application, however, it can be sensible to provide the first and second separating station together upstream of the bottom folding device, as a result of which the device according to the invention for producing receptacles is able to be realized in a more compact manner.

In addition, it can be provided that a punching device is provided which punches a handle opening at the same time in the front part and the rear part, wherein the punching device is incorporated in the tube forming device or is arranged downstream of the tube forming device. In order to reinforce the handle opening, it can be sensible to attach reinforcement strips at defined points of the material web. In an advantageous manner, said reinforcement strips are attached in the region of the handle opening on the inside of the front part and on the inside of the rear part. The attaching of the reinforcement strips can be effected by a device which is provided upstream of the punching device. In an advantageous manner the reinforcement strip encloses the handle opening. It is conceivable for the punching device to punch out part of the reinforcement strip, at least in part, at the same time as it punches out the handle opening.

The object of the present invention is additionally achieved by a method according to the invention for producing receptacles, in particular flexible bags made of paper, wherein the receptacle is realized with a front part, a rear part, a bottom which is closed by a bottom unit, as well as an opening which is located opposite the bottom and is defined by a peripheral edge, wherein the edge is formed by a front part edge of the front part and a rear part edge of the rear part. In this connection, said method according to the invention includes the following steps:

A) create perforation lines on a material web by means of a perforation device, wherein the perforation lines extend substantially transversely with respect to the conveying direction of the material web, B) form a tube from the material web by means of a tube forming device, C) separate off individual tube portions and/or material portions of tube portions on the perforation lines by means of a separating device, D) form a bottom on one end of the tube portion, wherein in step A) the perforation device forms a first perforation line for creating the bottom and a second perforation line, which is at a spacing from the first perforation line, for creating a frayed edge, wherein the front part edge and the rear part edge are at one height.

Possible embodiments are addressed in the present document.

It is particularly advantageous that two different perforation lines with different contours are introduced into the material web in the perforation device. In addition, during the production method perforations are introduced into the material web several times, the contour of the first perforation line differing substantially from the contour of the second perforation line. A receptacle that comprises a frayed edge in the region of the opening is produced by the second perforation line, the front part edge and the rear part edge being at one height. The advantages of a receptacle of this type have already been depicted such that at this point reference is simply made to what has been already said.

In an advantageous manner, the first perforation line comprises at least two regions which extend offset, at a spacing from and parallel to one another. The two regions on the material web serve for the purpose of being able to produce a folding bottom on the receptacle, a reliably closed bottom unit being created. A bottom unit with a bottom portion of the front part and a bottom portion of the rear part can be created by means of the first perforation line, the bottom portion of the rear part being realized in a shortened manner in relation to the bottom portion of the front part such that the bottom portion of the front part can be fastened directly to the rear part by folding over the bottom unit along a fold line. In an advantageous manner, the front part can comprise an outside and an inside and the rear part can comprise an outside and an inside, wherein the inside of the front part faces the inside of the rear part, wherein the bottom portion of the front part comprises an inside surface and an outside surface and the bottom portion of the rear part comprises an inside surface and an outside surface, wherein the inside surface of the bottom portion of the front part is glued to the rear part.

So that a "smooth" edge is created in the region of the opening of the receptacle, the second perforation line is realized as a geometric straight line. In an advantageous manner, the first region of the first perforation line can be at a distance X to the adjacent second perforation line which is approximately within the range of 1 mm≤X≤17 mm, in particular which is approximately within the range of 8 mm≤X≤11 mm. As an alternative to this and/or in addition to it, the second region of the first perforation line can be at a greater spacing Y to the adjacent second perforation line than the distance X which exists between the first region of the first perforation line and the adjacent second perforation line. In this connection, the separating device is realized in such a manner that during the separating-off process it is able to engage at the point of the material web which lies between the first perforation line and the second perforation line. The separating device can also include, for example, several pairs of rollers, two pairs of rollers being associated with the first separating station and two pairs of roller being associated with the second separating station. During the separating operation, the speed of one pair of rollers can be at least temporarily different to the speed of its adjacent pair of rollers, as a result of which the respective tube portion or the material portion of a tube portion is able to be torn off.

The above-mentioned method steps A), B), C) and D) can be carried out according to the invention in a sequential manner. It is equally conceivable for steps A), B), C) and D) to overlap at least in part.

It is additionally conceivable for the separating device to comprise a first separating station and a second separating station, wherein in a step C1) in the first separating station individual tube portions are separated off along the first perforation line, and in a step C2) in the second separating station material portions of tube portions are separated off along the second perforation line. Consequently, included in the invention is that the steps C1) and C2) run during the step C). It can be provided as an alternative that the step C1) runs during the step C) and the step C2) runs after the step D).

In a further measure improving the invention, it is conceivable that during the step B) or after the step B), a handle opening is punched in the front part and the rear part, wherein in particular prior to or during the step A) or the step B) reinforcement strips are attached in the region of the handle opening.

In addition, the method according to the invention is suitable to produce receptacles according to the description in the present document In addition, the device according to the invention according to one of embodiments as discussed in the present document is suitable to carry out the method just described.

BRIEF DESCRIPTION OF THE DRAWINGS

Further advantages, features and details of the invention are produced from the following description in which, with reference to the drawings, several exemplary embodiment of the invention are described in detail. In this case, the features mentioned in the claims and in the description can be fundamental to the invention in each case on their own or in arbitrary combination. The drawings are as follows:

DETAILED DESCRIPTION OF SPECIFIC EMBODIMENTS

Figure 1:
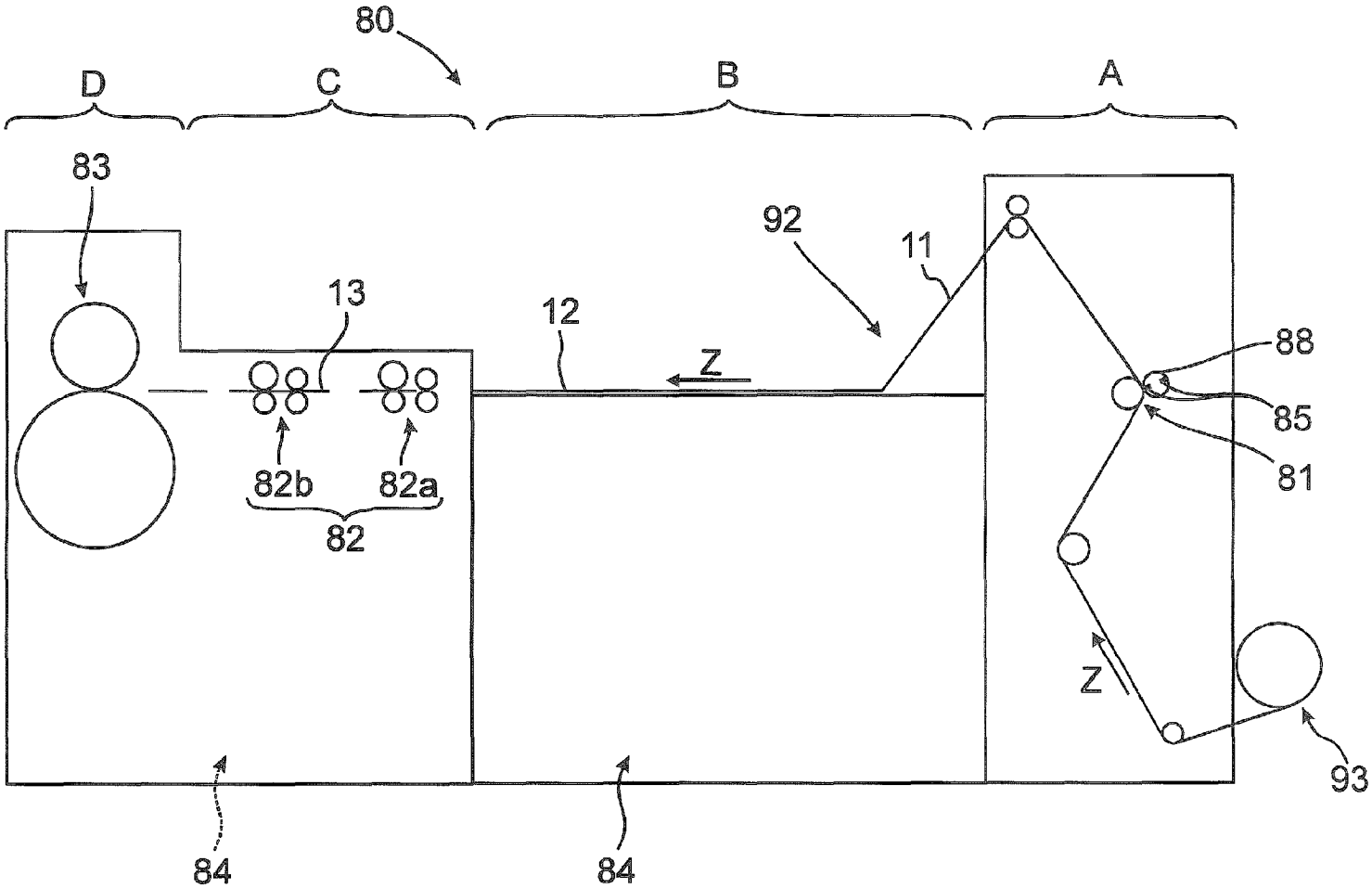
FIG. 1 shows a first possible device for producing receptacles according to the invention.
Figure 2:
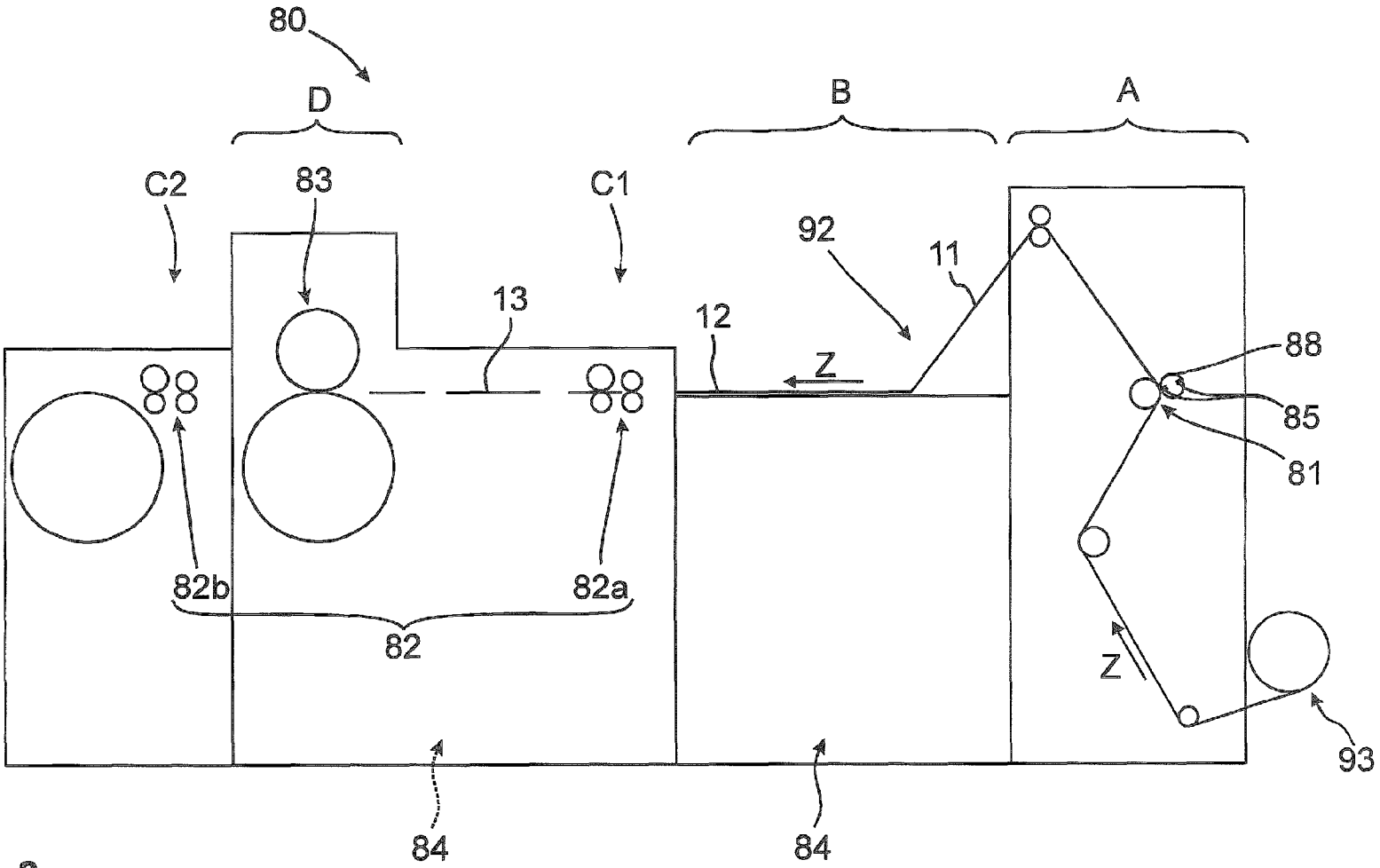
FIG. 2 shows a further exemplary embodiment of a device according to the invention for producing receptacles.
Figure 5:
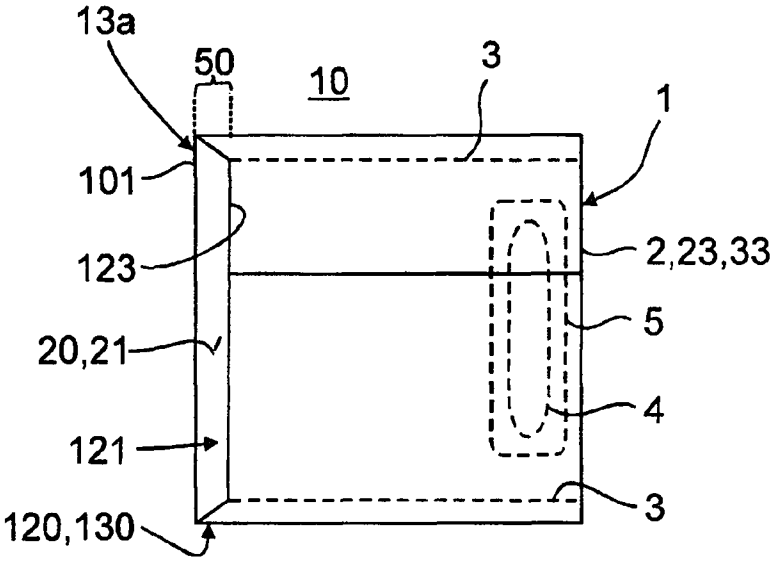
FIG. 5 shows a top view of a completed receptacle.
Figure 7:
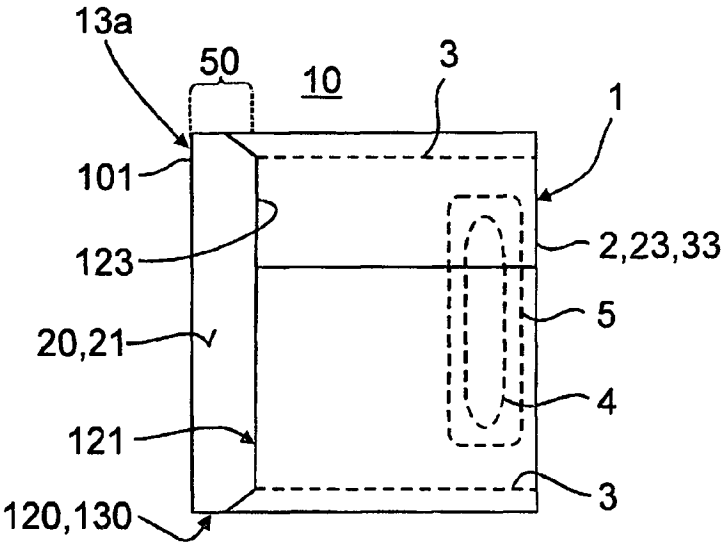
FIG. 7 shows a top view of a completed receptacle.

FIGS. 1 and 2 show two possible devices 80 for producing receptacles 10 which are shown as an example in FIG. 5 or in FIG. 7. Said receptacles 10, in the present exemplary embodiment, are flexible bags 10 made of paper. FIGS. 1 and 2 simply show the essential components of said device 80 in a schematic manner. The device 80 includes an unwinding device 93 to which is supplied a material web 11 in the form of a winding. Proceeding from said unwinding device 93, the web 11 is supplied to a perforation device 81 via guide rollers which are not provided explicitly with references. The perforation device 81 includes several transverse perforating blades which serve a cutting elements 87 in order to provide the material web 11 with perforations 60, 70. In this connection, the cutting elements 87 are shown explicitly in FIG. 8, more details thereof being given below. The perforation lines 60, 70, which extend transversely with respect to the conveying direction Z of the material web 11, are shown schematically in FIG. 3. The perforation line 60, 70, in this connection, do not cut through the web 11 but bring about a weakening along the perforation lines 60, 70, along which individual regions of the outer web 11 are subsequently torn off or singled out. Said singling out takes place in a separating device 82, more details thereof being given below.

Figure 3:
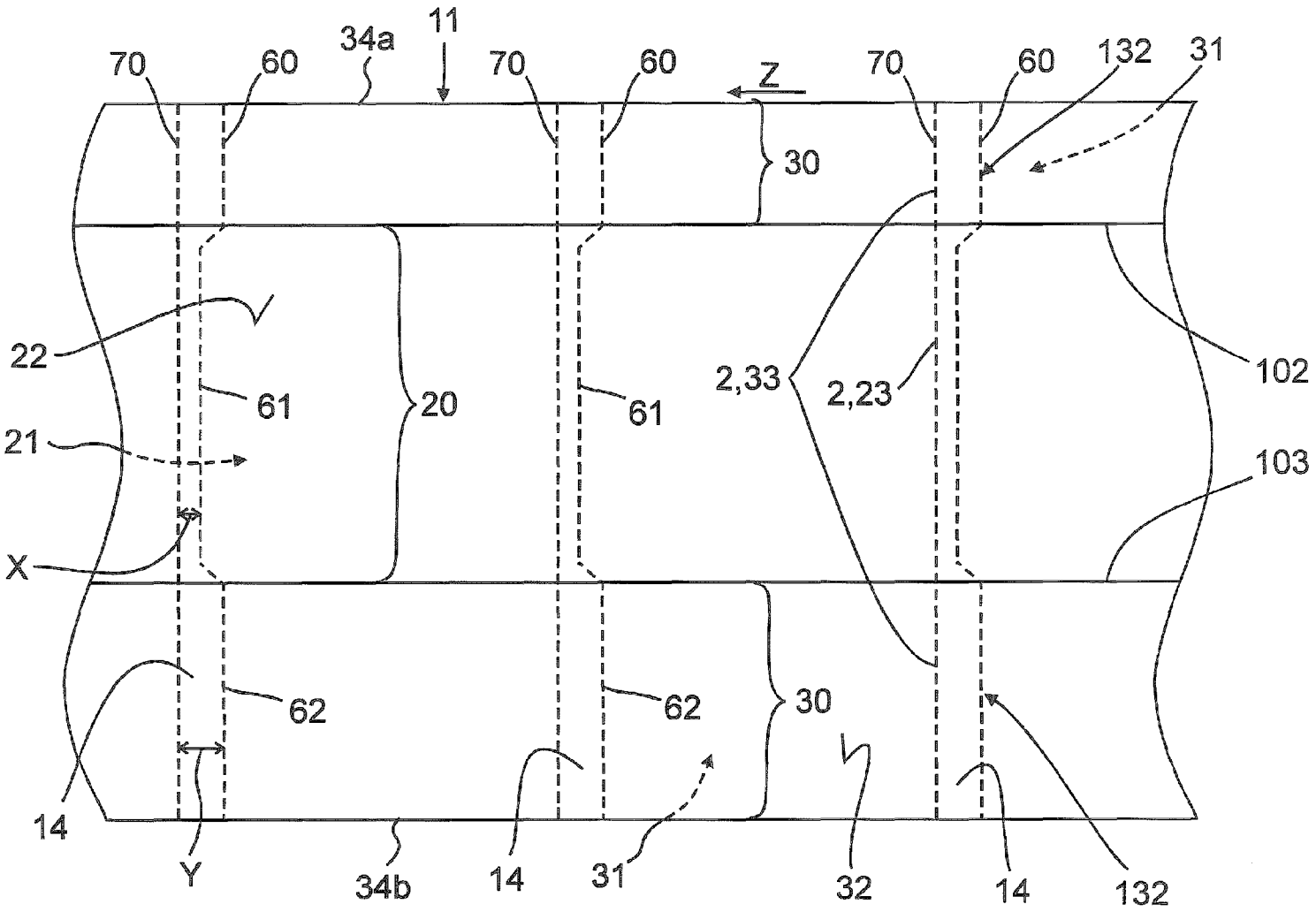
FIG. 3 shows a top view of a material web which is provided with perforations or perforation lines.
Figure 4:
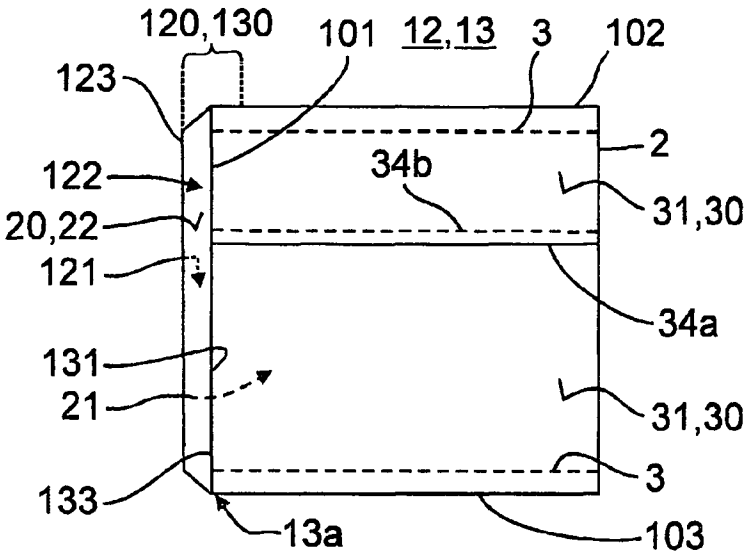
FIG. 4 shows a top view of a tube portion that has been singled out.
Figure 6:
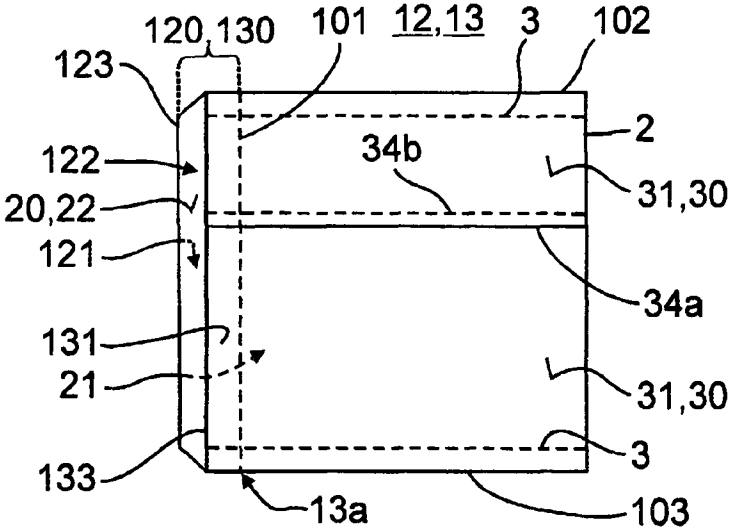
FIG. 6 shows a further exemplary embodiment of a top view of a tube portion which has been singled out.

Once then the material web 11 has been provided with the perforation lines 60, 70 according to FIG. 3, the material web 11 leaves the right-hand part region of the device 80 and is supplied to tube forming device 92 in which the material web 11 is formed into a tube 12 according to FIG. 4 or FIG. 6. This is effected, for example, by way of guide plates which are knocked in at the side such that the edges 34*a*, 34*b* or the defining sides 34*a*, 34*b* of the material web 11 then overlap. This is particularly clear in FIG. 4 and FIG. 6 as there is a spacing between the edges 34*a* and 34*b*. The edge 34*b* lies beneath the edge 34*a*, a suitable adhesive being glued for longitudinal adhesion between said two edges 34*a*, 34*b*. The folding is effected along the fold lines 102 and 103.

Said formed tube 12 leaves the tube forming device 92, the tube 12 still being an endless tube 12 in said stage. The tube 12 is then supplied to a separating device 82 which separates the tube 12 according to the perforation lines 60, 70. According to FIG. 1, the separating device 82 comprise a first 82*a* and a second 82*b* separating station. Said two separating stations 82*a*, 82*b* are connected directly one behind another in FIG. 1. Behind the second separating station 82*b* is situated a bottom folding device 83, more details of which will follow below. Contrary to this, the bottom folding device 83 in FIG. 2 is arranged between the first 82*a* and the second separating station 82*b*. According to FIG. 1 and FIG. 2, the first separating station 82*a* separates the tube 12 into individual tube portions 13 along the first perforation line 60. The second separating station 82*b* separates material portions 14 of the tube portions 13 along the second perforation line 70.

According to FIG. 5 and FIG. 7, a receptacle 10 is created with a front part 20, a rear part 30 and a bottom 50 which is closed by a bottom unit 120, 130. Said bottom unit comprises a bottom portion 120 of the front part 20 and a bottom portion 130 of the rear part 30 which is shown in FIG. 4 and in FIG. 6. The bottom portion 130 of the rear part 30 is realized in a shortened manner in relation to the bottom portion 120 of the front part 20 such that the bottom portion 120 of the front part 20 is fastened, in particular is glued, directly on the rear part 30 as result of folding the bottom unit along a folding line 101, which is effected in the bottom folding device 83.

The receptacle 10 comprises an opening 1 which is located opposite the bottom 50, is formed by a peripheral edge 2 and is frayed on account of the perforation line 70, as a result of which the risk of injury on the edge 2 is reduced. According to FIG. 5 and FIG. 7, the edge 2 is realized at least in part in the manner of a perforation which can be felt by the user.

The bottom portion 130 of the rear part 30 and the bottom portion 120 of the front part 20 also comprise a frayed edge 123, 133.

According to FIG. 4 and FIG. 6, it is shown as an example that at least one side folding 3 can be provided between the front part 20 and the rear part 30. It can also be provided that the front part 20 and/or the rear part 30 can also be realized at least in part from a transparent material.

By means of a broken line, FIG. 5 and FIG. 7 show in each case a handle opening 4 which is realized on the front part 20 and on the rear part 30. Said handle opening 4 is punched out, it being possible to provide a punching device 84 for this purpose which can be arranged, for example, in the tube forming device 92 or downstream of the tube forming device 92, which is shown schematically in FIG. 1 and FIG. 2.

So that the handle opening 4 obtains greater stability, the receptacle 10 according to FIG. 5 and according to FIG. 7 comprises a reinforcement strip 5 in the region of the handle opening 4. The reinforcement strips 5 are glued in the region of the handle opening 4 on the inside 22 of the front part as well as on the inside 32 of the rear part 30. In an expedient manner, said reinforcement strips 5 are attached to the material web 11 or to the tube 12 upstream of the punching device 84 inside the device 80.

The outside surface 121 of the bottom portion 120 of the front part 20 can serve as an information field or information surface which is indicated schematically in FIG. 5 and in FIG. 7.

According to FIG. 4 and FIG. 6, the front part 20 comprises an outside 21 and an inside 22. The rear part 30, in contrast, comprises an outside 31 and an inside 32, the inside 32 being shown in FIG. 3 according to the material web 11. The inside 22 of the front part 20 faces the inside 32 of the rear part 30, the bottom portion 120 of the front part 20 comprising an inside surface 122 and an outside surface 121. The bottom portion 130 of the rear part 30 is realized with an inside surface 132 and an outside surface 131 which can also be seen in FIG. 3. According to FIG. 5 and FIG. 7, the inside surface 122 of the bottom portion 120 of the front part 20 is glued to the rear part 30.

The edge 2 of the opening 1 is formed by a front part edge 23 of the front part 20 and a rear part edge 33 of the rear part 30 which is shown in FIG. 3 within the material web 11. In FIG. 5 and in FIG. 7, the front part edge 23 and the rear part edge 33 are at one height. This is brought about in that a straight perforation line 70 is introduced in the material web 11.

According to FIG. 1 and FIG. 2, the following steps are provided in the method according to the invention for producing receptacles 10:

A) create perforation lines 60, 70 on a material web 11 by means of a perforation device 81, wherein the perforation lines 60, 70 extend substantially transversely relative to the conveying direction Z of the material web 11, B) form a tube 12 from the material web 11 by means of a tube forming device 92, C) separate off individual tube portions 13 and/or material portions 14 of tube portions 13 on the perforation lines 60, 70 by means of a separating device 82, D) form a bottom 50 on one end 13A of the tube portion 13, wherein in step A) the perforation device 81 forms a first perforation line 60 for creating the bottom 50 and a second perforation line 70, which is at a spacing from the first perforation line 60, for creating a frayed edge 2, wherein the front part edge 23 and the rear part edge 33 are at one height.

In this connection, the first perforation line 60 comprises at least two regions 61, 62 which extend offset, at a spacing from and parallel to one another, which is shown in FIG. 3. The first perforation line 60 consequently extends substantially transversely with respect to the conveying direction Z of the material web 11. The second perforation line 70 is realized as a geometric straight line. The first perforation line 60 is realized in a ramp-shaped manner and has a defined contour. The first region 61 of the first perforation line 60 is at a spacing X to the adjacent second perforation line 70 which lies approximately within the range of between 1 mm≤x≤17 mm. The second region 62 of the first perforation line 60 is at a greater spacing Y to the adjacent second perforation line 70 than the spacing X which exists between the first region 61 of the first perforation line 60 and the adjacent second perforation line 70. The difference between Y and X can be ≥20 mm in one exemplary embodiment. Said geometric development is dependent on the geometric forms of the receptacles. With regard to the separating device 82, it must be mentioned in this context that the separating device 82 can operate in said smaller region X and/or Y in order to be able to carry out online a separating process along the perforation line 70 and/or 60.

The above-mentioned steps A) to D) can be carried out in a sequential manner. It is equally conceivable for the steps to be able to overlap at least in part in a further exemplary embodiment. As FIG. 2 makes clear, it is conceivable for the separating device 82 with its first separating station 82*a* to be arranged upstream of the bottom folding device 83 and the second separating station 82*b* to be placed downstream of the bottom folding device 83.

Figure 10:
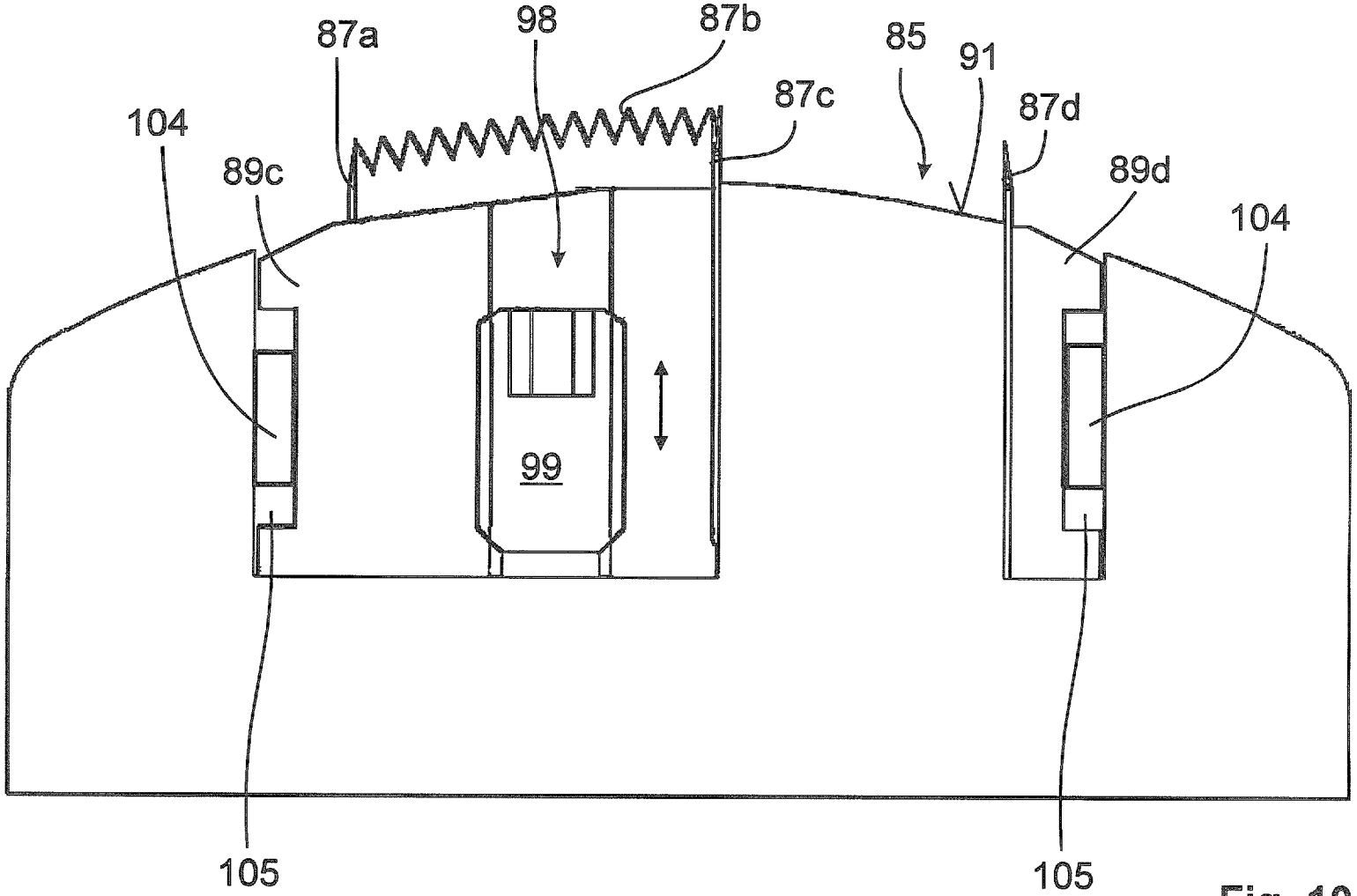

The strip element 85, which is mounted on the shaft 88 according to FIG. 1 and FIG. 2, is shown in figure to FIG. 10. For example, it is conceivable to provide two or a plurality of strip elements 85 on the perforation device 81 such that a corresponding perforation with the perforation lines 60, 70 can be carried out. The strip element 85 comprises two receiving means 86 which are realized in a groove-shaped manner. Cutting elements 87*a*, 87*b*, 87*c* and 87*d* are arranged in the receiving means 86. The cutting element 87*d* is responsible for the perforation line 70 according to FIG. 3. Five further cutters 78*a*, 78*b*, 78*c*, which are responsible for the perforation line 60, are arranged above the cutter 87*d*.

Figure 8:
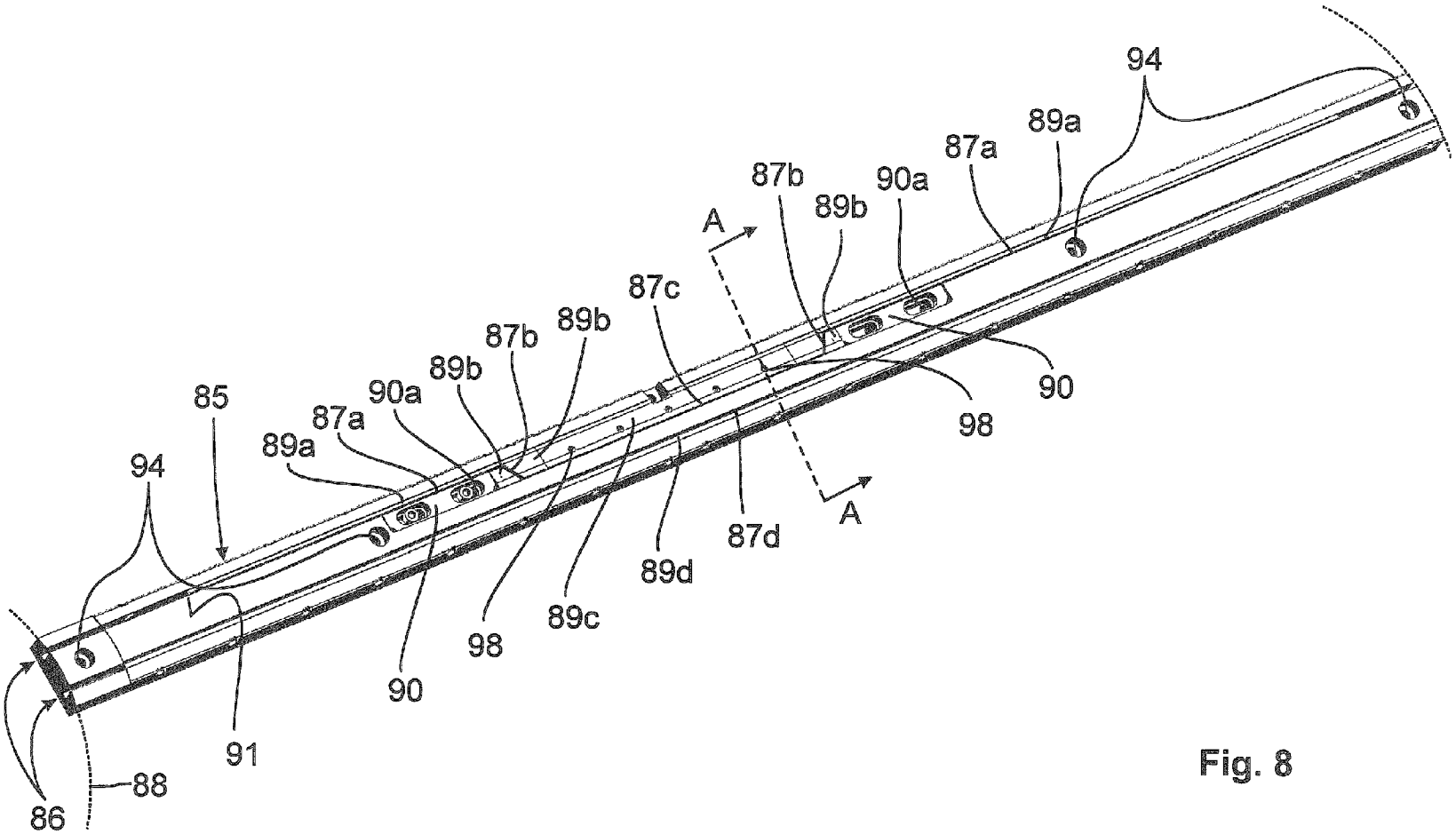
FIG. 8 shows a purely schematic view of a strip element which is a component part of a perforation device of the device according to the invention for producing receptacles.
Figure 9:
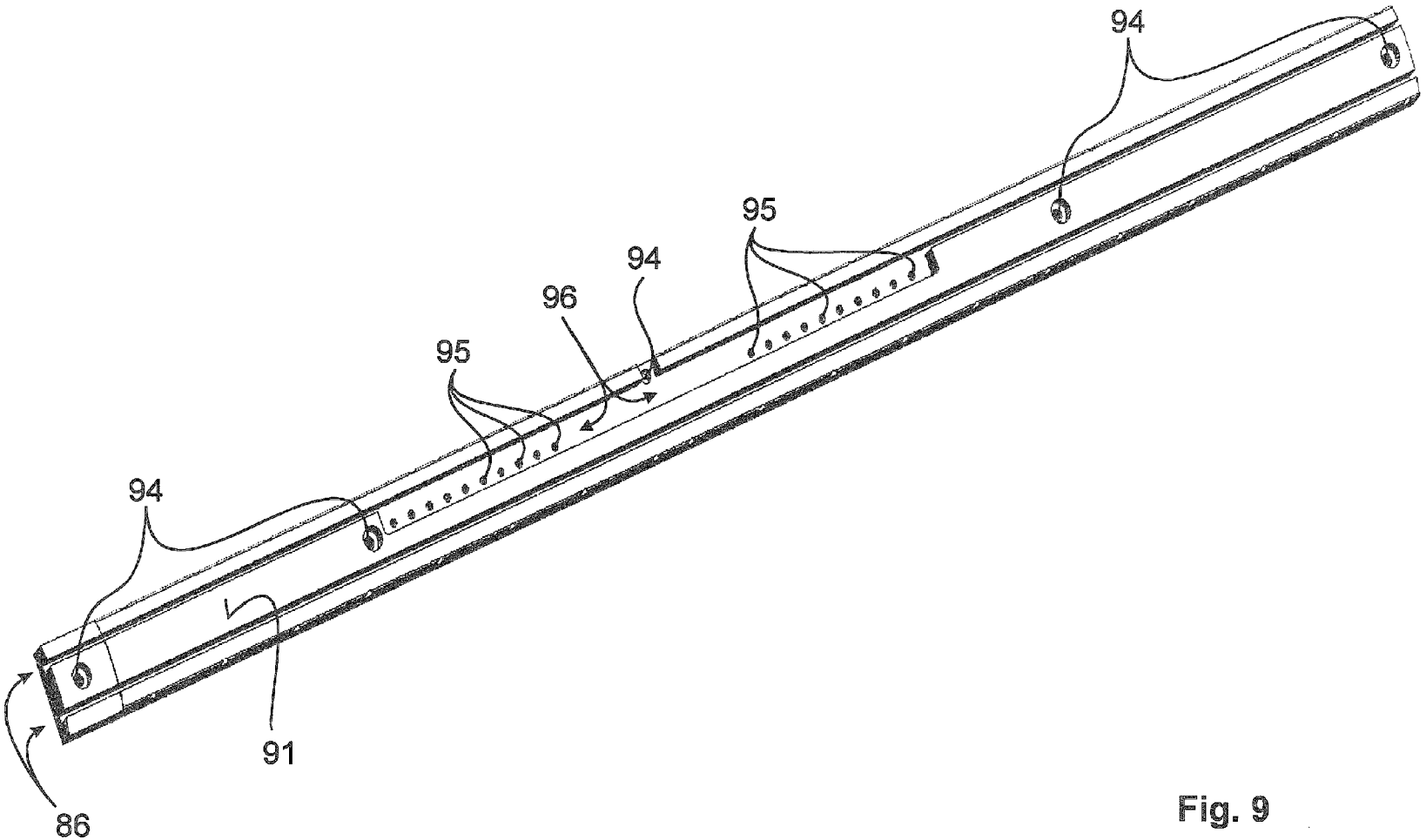
FIG. 9 shows the strip element according to FIG. 8 in a further state and FIG. 10 shows a sectional view according to the line of intersection A-A from FIG. 8.

As is indicated in FIG. 8 and FIG. 10, the outside region 91 of the strip element 85 comprises in cross section the contour of a segment of a circle. The cutting elements 87 project out of the outside region 91 of the strip element 85, which is shown in FIG. 10. The strip element 85 comprises clamping elements 89 which hold the cutting elements 87 in a clamping manner. In addition, two holding means 90 are realized each with two elongated holes 90*a* which bring about the clamping connection between the clamping elements 89 and the cutting elements 87. If, then, the contour of the cutting elements 87 is to be modified, the holding means 90 can be released by the screw elements in the elongated holes 90*a* being unscrewed. The cutting elements 87*a*, 87*b*, 87*c* and the clamping elements 89*a*, 89*b*, and 89*c* can then be removed from the strip element such that the situation according to FIG. 9 is set. As is shown in a very clear manner, the strip element 85 comprises a space 96 in which the cutting elements 87*a*, 87*b*, 87*c* and the associated clamping elements 89*a*, 89*b*, 89*c* according to FIG. 8 were inserted beforehand. If it is desired, for example, to shorten the center cutting element 87*c*, the short cutting elements 87*b* are pushed toward one another and a corresponding cutting element 87*c* and two cutting elements 87*a* are placed into the receiving means 86 or into the space 96 in a modular manner. In addition, clamping elements 89 matching hereto are placed into the space 96 so that a reliable clamping of the cutting elements 87*a*, 87*b* and 87*c* is ensured. The holding means are positioned in a corresponding manner in the space 96 of the strip element 85, the space 96 comprising a plurality of bores 95 in its bottom region so that a reliable and flexible fastening of the holding means 90 is able to be brought about by means of the elongated holes 90*a*.

In addition, the strip element 85 includes several openings 94 which serve for fastening the strip element 85 on the rotating shaft 88.

FIG. 10 additionally shows that the cutters 87*a*, 87*b*, 87*c* are able to be height-adjusted. To this end, the clamping element 89*c* comprises adjustment openings 98 which are also shown schematically in FIG. 8. An adjustment element 99, which is able to be adjusted by means of a tool, is shown in the adjustment opening 98, as a result of which the height of the cutting elements 87*a*, 87*b*, 87*c* is able to be adjusted. In the present exemplary embodiment, the adjustment element 99 comprises a thread at the side such that by means of a rotation of the adjustment element 99 a height displacement of the cutting elements 87*a*, 87*b*, 87*c* can be brought about. As the height of the clamping element 89*c* is displaceable, an elongated hole 105 is provided so that no collision with the fastening element 104 takes place. The function of the fastening element 104, which is a threaded pin in the present exemplary embodiment, is to fix the clamping element 89*b*, 89*c* and/or the cutting element 87*a*, 87*b*, 87*c* additionally at the side. A fastening element 104, which has the same function, is also arranged on the opposite side on the clamping element 89*d*.

LIST OF REFERENCES

1 Opening
2 Edge
3 Side folding
4 Handle opening
5 Reinforcement strip

10 Receptacle, bag
11 Material web
12 Tube
13 Tube portion
13*a* End of the tube portion 13
14 Material portion
20 Front part
21 Outside
22 Inside
23 Front part edge
30 Rear part
31 Outside
32 Inside
33 Rear part edge
34*a* Defining side
34*b* Defining side
50 Bottom
60 Perforation line
61 First region
62 Second region
70 Perforation line
80 Device, machine
81 Perforation device
82 Separating device
82*a* First separating station
82*b* Second separating station
83 Bottom folding device
84 Punching device
85 Strip element
86 Receiving means
87 Cutting element
88 Shaft
89 Clamping element
90 Holding means
90*a* Elongated hole
91 Outside region of 85
92 Tube forming device
93 Unwinding device
94 Opening
95 Bore
96 Space
97 Fastening element
98 Adjustment opening
99 Adjustment element
101 Fold line
102 Fold line
103 Fold line
104 Fastening element, threaded pin
105 Elongated hole
120 Bottom portion
121 Outside surface
122 Inside surface
123 Edge
130 Bottom portion
131 Outside surface
132 Inside surface
133 Edge

What is claimed is:

1. A receptacle (10), comprising a flexible bag (10) made of paper, having a front part (20), a rear part (30) and a bottom (50) which is closed by a bottom unit, and having an opening (1) which is located opposite the bottom (50), wherein the bottom unit comprises a bottom portion (120) of the front part (20) and a bottom portion (130) of the rear part (30), the bottom portion (130) of the rear part (30) is realized in a shortened manner in relation to the bottom portion (120) of the front part (20) such that the bottom portion (120) of the front part (20) is fastened directly on the rear part (30) as a result of turning the bottom unit (100) along a fold line (101), the opening (1) is formed by a peripheral edge (2) which extends at a height of the front part (20) and of the rear part (30) and which is frayed at least in part, as a result of which the risk of injury on the edge (2) is reduced, the edge (2) is frayed in a manner of both a perforation defined by a weakening on the paper without a cut through the paper and being torn off along the perforation;

wherein a handle opening (4) is punched out on the front part (20) and on the rear part (30);

wherein in a region of the handle opening (4) an inside (22) of the front part (20) and an inside (32) of the rear part (30) comprise a reinforcement strip (5);

wherein the reinforcement strip (5) is at least partially punched out at the same time as the handle opening (4) is punched out.

2. The receptacle (10) as claimed in claim 1, characterized in that the edge (2) is realized in the manner of a perforation line defined by a weakening on the paper without a cut through the paper and being torn off along the perforation line.

3. The receptacle (10) as claimed in claim 1, characterized in that the bottom portion (130) of the rear part (30) and the bottom portion (120) of the front part (20) comprise a frayed edge (123, 133) realized in a manner of a perforation defined by a weakening on the paper without a cut through the paper and being torn off along the perforation.

4. The receptacle (10) as claimed in claim 1, characterized in that the front part (20) comprises an outside (21) and an inside (22) and the rear part (30) comprises an outside (31) and an inside (32), wherein the inside (22) of the front part (20) faces the inside (32) of the rear part (30), wherein the bottom portion (120) of the front part (20) comprises an inside surface (122) and an outside surface (121) and the bottom portion (130) of the rear part (30) comprises an inside surface (132) and an outside surface (131), wherein the inside surface (122) of the bottom portion (120) of the front part (20) is glued to the rear part (30).

5. The receptacle (10) as claimed in claim 1, characterized in that at least one side folding (3) extends between the front part (20) and the rear part (30).

6. The receptacle (10) as claimed in claim 1, characterized in that the edge (2) of the opening (1) is formed at least in part by a front part edge (23) of the front part (20) and a rear part edge (33) of the rear part (30), wherein the front part edge (23) and the rear part edge (33) are at one height.

7. A receptacle (10), comprising a flexible bag (10) made of paper, having a front part (20), a rear part (30) and a bottom (50) which is closed by a bottom unit, and having an opening (1) which is located opposite the bottom (50), wherein the bottom unit comprises a bottom portion (120) of the front part (20) and a bottom portion (130) of the rear part (30), the bottom portion (130) of the rear part (30) is realized in a shortened manner in relation to the bottom portion (120) of the front part (20) such that the bottom portion (120) of the front part (20) is fastened directly on the rear part (30) as a result of turning the bottom unit (100) along a fold line (101), the opening (1) is formed by a peripheral edge (2) which extends at a height of the front part (20) and of the rear part (30) and which is frayed at least in part, as a result of which the risk of injury on the edge (2) is reduced, the edge (2) is frayed in a manner of both a perforation defined by a weakening on the paper without a cut through the paper and being torn off along the perforation;

wherein a handle opening (4) is realized by a laser on the front part (20) and on the rear part (30);

wherein in a region of the handle opening (4) an inside (22) of the front part (20) and an inside (32) of the rear part (30) comprise a reinforcement strip (5);

wherein the reinforcement strip (5) is at least partially realized by a laser.

* * * * *